US007167149B2

(12) United States Patent
Sung et al.

(10) Patent No.: US 7,167,149 B2
(45) Date of Patent: Jan. 23, 2007

(54) DRIVING CIRCUIT OF DISPLAY AND FLAT PANEL DISPLAY

(75) Inventors: Kuang-Feng Sung, Taichung County (TW); Tsun-Tu Wang, Taichung (TW); Chun-Yi Chou, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 568 days.

(21) Appl. No.: 10/707,676

(22) Filed: Jan. 2, 2004

(65) Prior Publication Data

US 2005/0093797 A1 May 5, 2005

(30) Foreign Application Priority Data

Nov. 4, 2003 (TW) ..... 92130766 A

(51) Int. Cl.
*G09G 3/36* (2006.01)

(52) U.S. Cl. ..... 345/89; 345/87

(58) Field of Classification Search ..... 345/83–87, 345/88–90, 91–100, 104, 204; 348/674
See application file for complete search history.

(56) References Cited

U.S. PATENT DOCUMENTS 6,593,934 B1 * 7/2003 Liaw et al. ..... 345/590
2002/0063666 A1 * 5/2002 Kang et al. ..... 345/87
2003/0001810 A1 * 1/2003 Yamaguchi et al. ..... 345/87
2003/0169248 A1 * 9/2003 Kim et al. ..... 345/204
2004/0160402 A1 * 8/2004 Kim et al. ..... 345/89

FOREIGN PATENT DOCUMENTS

TW 519614 2/2003
TW 559770 11/2003

* cited by examiner

*Primary Examiner*—Nitin Patel
(74) *Attorney, Agent, or Firm*—Jianq Chyun IP Office

(57) ABSTRACT

A driving circuit and a flat panel display using thereof are disclosed. The driving circuit includes a gamma voltage generator, a plurality of first buffers and a converter. The gamma voltage generator is used for providing a plurality of first gamma voltages. Each of the first buffers is provided for receiving each of the first gamma voltages to generate a second gamma voltage respectively. The converter is provided for receiving the second gamma voltages and the first display data to output the image driving signal by selecting one of the corresponding second gamma voltages according to the first display data.

20 Claims, 3 Drawing Sheets

DRIVING CIRCUIT OF DISPLAY AND FLAT PANEL DISPLAY

CROSS REFERENCE TO RELATED APPLICATIONS

This application claims the priority benefit of Taiwan application serial no. 92130766, filed Nov. 4, 2003.

BACKGROUND OF INVENTION

1. Field of the Invention

The present invention generally relates to a display and a driving circuit thereof, and more particularly to a flat panel display and a driving circuit thereof.

2. Description of the Related Art

Because of the advance of technology, electronic devices are widely used in our daily life, such as ATM, PC, cellular phone and TV. We can get information through the displays.

In recently years, the flat panel display (FPD) has gradually replaced the traditional cathode ray tube (CRT) display. The flat panel display (FPD) may be classified into a liquid crystal display (LCD), a plasma display panel (PDP), an organic light emitting display (OLED), a field emission display (FED), etc. In almost all of the flat panel display FPD, a plurality of scanning (gate) signals is incorporated with a plurality of data (source) signals for generating images on the display. FIG. 1 illustrates an example of LCD.

FIG. 1A is a schematic circuit block diagram showing a driving circuit and a source driving circuit of a conventional LCD. The LCD 110 includes a plurality of gate terminals 113 and a plurality of source terminals 115. Each intersection of the gate terminals 113 and source terminals 115 has a pixel. The turn-on or turn-off of the pixel is dependent on the gate signals. The gate signal is generated from the gate driver 120 according to the scanning signal 147. The source signal is generated from the source driver 100. The source driver 100 receives a horizontal synchronous signal 143, the display data 145 and a plurality of gamma adjusting voltages 152 for generating the image driving signals.

FIG. 1B is a circuit block diagram of the source driver 100 of FIG. 1A, wherein only one set of channel driver 130 is shown. The gamma voltage generator 150 can receive a plurality of gamma adjusting voltages 152 for generating gamma voltages 151. The shift register 132 receives the display data 145 in serial for outputting the display data 133 in parallel. The line buffer 134 receives and latches the display data 133 for generating the display data 135 according to a timing of the horizontal synchronous signal 143. The D/A converter 136 receives the display data 135 and the gamma voltages 151 for outputting the image driving signal 137 by selecting one of the corresponding gamma voltages according to the display data 135. In order to enhance the driving ability of the image driving signals, a buffer 138 is connected to each output terminal of the source driver so that the buffer 138 receives the image driving signal 137 for outputting the image driving signal 139.

According to the conventional source driving circuit, the buffer 138 is provided for enhancing the driving ability of the signal (such as the current of the signal) without changing the signal characteristic (such as the voltage of the signal). In order to provide sufficient signal driving ability to the pixel, the conventional LCD 110 provides a buffer 138 at each source terminal. For example, if the LCD 110 has 400 source terminals, correspondingly 400buffers are required, and accordingly, the high power consumption thereof is substantially high.

SUMMARY OF INVENTION

Therefore, one object of the present invention is to provide a driving circuit of a display for reducing power consumption and heat generated from the buffers. Moreover, the present invention can also reduce the number of components in the driving device allowing further shrinkage in size and area of the circuit and thereby reducing the cost.

Another object of the present invention is to provide a driving circuit of a flat panel display for reducing power consumption and heat generation. Moreover, the present invention can also reduce the number of components in the driving device allowing further shrinkage in size and area of the circuit and reduce the cost.

In order to achieve the above objects and other advantages of the present invention, a driving circuit of a display for converting a first display data to an image driving signal is provided. The driving circuit includes a gamma voltage generator, a plurality of first buffers and a converter. The gamma voltage generator is used to provide a plurality of first gamma voltages. Each of the first buffers is provided for receiving each of the first gamma voltages to generate a second gamma voltage respectively. The converter is provided for receiving the second gamma voltages and the first display data to output the image driving signal by selecting one of the corresponding second gamma voltages according to the first display data.

According to one preferred driving circuit of the display, the gamma voltage further receives a plurality of gamma adjusting voltages for generating a plurality of corresponding first gamma voltages. Additionally, the driving circuit is further provided for receiving a horizontal synchronous signal and a second display data, wherein the driving circuit of a display further includes, for example but not limited to, a shift register and a second buffer. The shift register is provided for receiving the second display data to generate a third display data. The second buffer is provided for receiving the third display data and the horizontal synchronous signal is provided to latch the third display data according to a timing of the horizontal synchronous signal and to generate the first display data.

In order to achieve the above objects and other advantages of the present invention, a flat panel display is disclosed. The flat panel display includes a display panel, a timing controller, a set of gate driving circuits and a set of source driving circuits. The display panel has a plurality of pixels. The timing controller is provided for outputting a scanning signal, a first display data and a horizontal synchronous signal. The set of gate driving circuits has a plurality of gate drivers for receiving the scanning signal. The set of source driving circuit has a plurality of source drivers, wherein each of the source drivers converts a first display data into an image driving signal according to a timing of the horizontal synchronous signal. The source driver includes, for example but not limited to, a gamma voltage generator, a plurality of first buffers and a converter. The gamma voltage generator is used for providing a plurality of first gamma voltages. Each of the first buffers is provided for receiving each of the first gamma voltages to generate a second gamma voltage respectively. The converter is provided for receiving the second gamma voltages and the first display data to output the image driving signal by selecting one of the corresponding second gamma voltages according to the first display data.

Accordingly, in the present invention since a buffer is disposed at each gamma voltage output terminal of the gamma voltage generator, and therefore buffers at the source terminals as required in the prior art liquid crystal display are not required. Therefore, the present invention can reduce the power consumption and heat generated from the buffers. Moreover, the present invention also reduces the number of components in the driving circuit device allowing further shrinkage in size and area of the driving circuit and reduces the cost. Because the need of a buffer for each source terminal can be avoided, and therefore when the number of source terminals increase with the increase in number of pixels, buffers for the source terminals are not required. Accordingly, the number of the components in the driving device can be significantly reduced allowing shrinkage in size and area of the driving circuit and also the cost thereof is significantly reduced.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In general, a plurality of buffers are usually disposed at the input terminals of the source of the prior art driving circuit of the display panel for enhancing the driving ability of the signals. In other words, the buffers are disposed at the output ends of the of the source drivers. Therefore, if a display has, for example, 400 source terminals, in the prior art structure 400 buffers are required. Alternatively, the present invention provides a buffer at each gamma voltage output terminal of the gamma voltage generator for overcoming the problems of requiring a large number of buffers for a correspondingly large number of source terminals as in case of the prior art. For example, if R, G and B color each has a six-bit data, 64 gray level gamma voltages are required. Thus, in the present invention, only 64 buffers are required. In the present invention, the number buffers need not be equal to the number of the source terminals and in fact can be substantially less than the number of the source terminals. Accordingly, the chip area, the power consumption and the heat generation from the buffers can be substantially reduced. Moreover, the present invention also reduces the number of components in the driving device allowing further shrinkage in size and area of the circuit and reduces the costs thereof.

Figure 2:
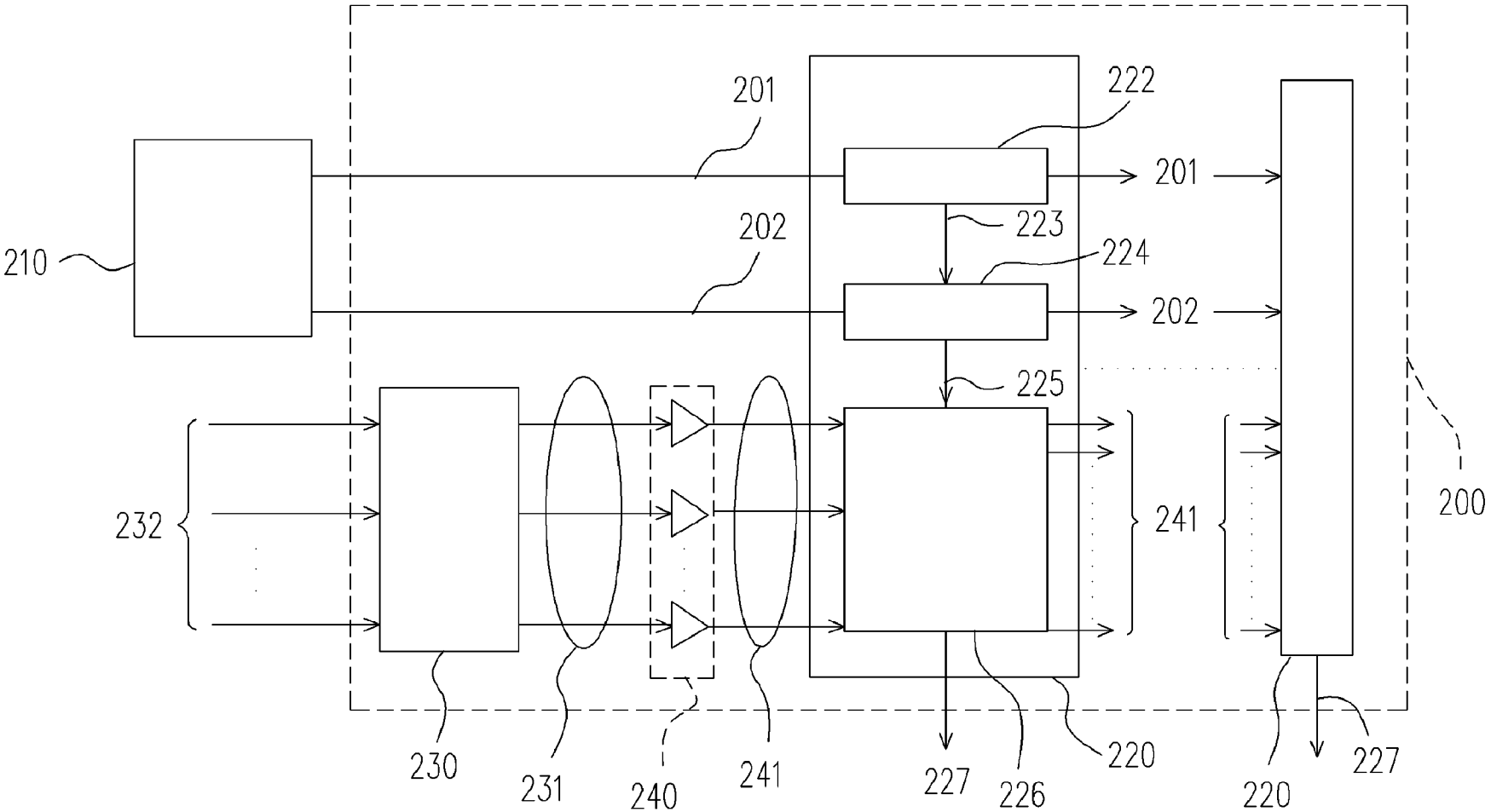
FIG. 2 is a schematic circuit block diagram showing a driving circuit of a liquid crystal display according to a preferred embodiment of the present invention.

Hereinafter, a liquid crystal display (LCD) according to a preferred embodiment of the preset invention is described. FIG. 2 is a schematic circuit block diagram showing a driving circuit of a liquid crystal display according to a preferred embodiment of the present invention. The image driving signal 227 outputted from the channel terminal 220 is connected to, for example, a source terminal of the LCD 110 (not shown in FIG. 2). The LCD has a plurality of source terminals, such as 400 or more source terminals. Each channel driver is connected to and provides each source terminal the image driving signal. In FIG. 2, only one set of channel driver 220 is shown as an example.

Referring to FIG. 2, the channel driver 220 receives a display data 201, which can be, for example but not limited to, a digital signal in serial. The shift register 222 receives and stores the display data 201, then outputs the stored display data 223, wherein the display data 223 can be, for example but not limited to, a digital signal in parallel. The line buffer 224 receives the horizontal synchronous signal 202 and outputs the display data 225 by latching the display data 223 in the line buffer 224.

In the present invention, the gamma generator 230 can receive a plurality of gamma adjusting voltages 232 and output the gamma voltages 231 corresponding to the gamma adjusting voltages 232. The gamma generator 230 can also generate a plurality of different gamma voltages 231. Each of the gamma voltages 231 represents a pixel gray level. In the embodiment, the gamma voltages 231 may have, for example but not limited to, 64 gray levels. In order to enhance the driving ability of the gamma voltages 231, a buffer 240 is connected to each gamma voltage 231. Each buffer 240 receives a level gamma voltage 231 and outputs a gamma voltage 241. The buffer 240 is provided for enhancing the driving ability of the signal (such as the current of the signal) but without changing the characteristic of the signal (such as the voltage of the signal). The D/A converter 226 receives the display data 225 and the gamma voltage 241 simultaneously, and outputs the image driving signal 227 by selecting the corresponding gamma voltage 241 according to the display data 225.

Figure 1A:
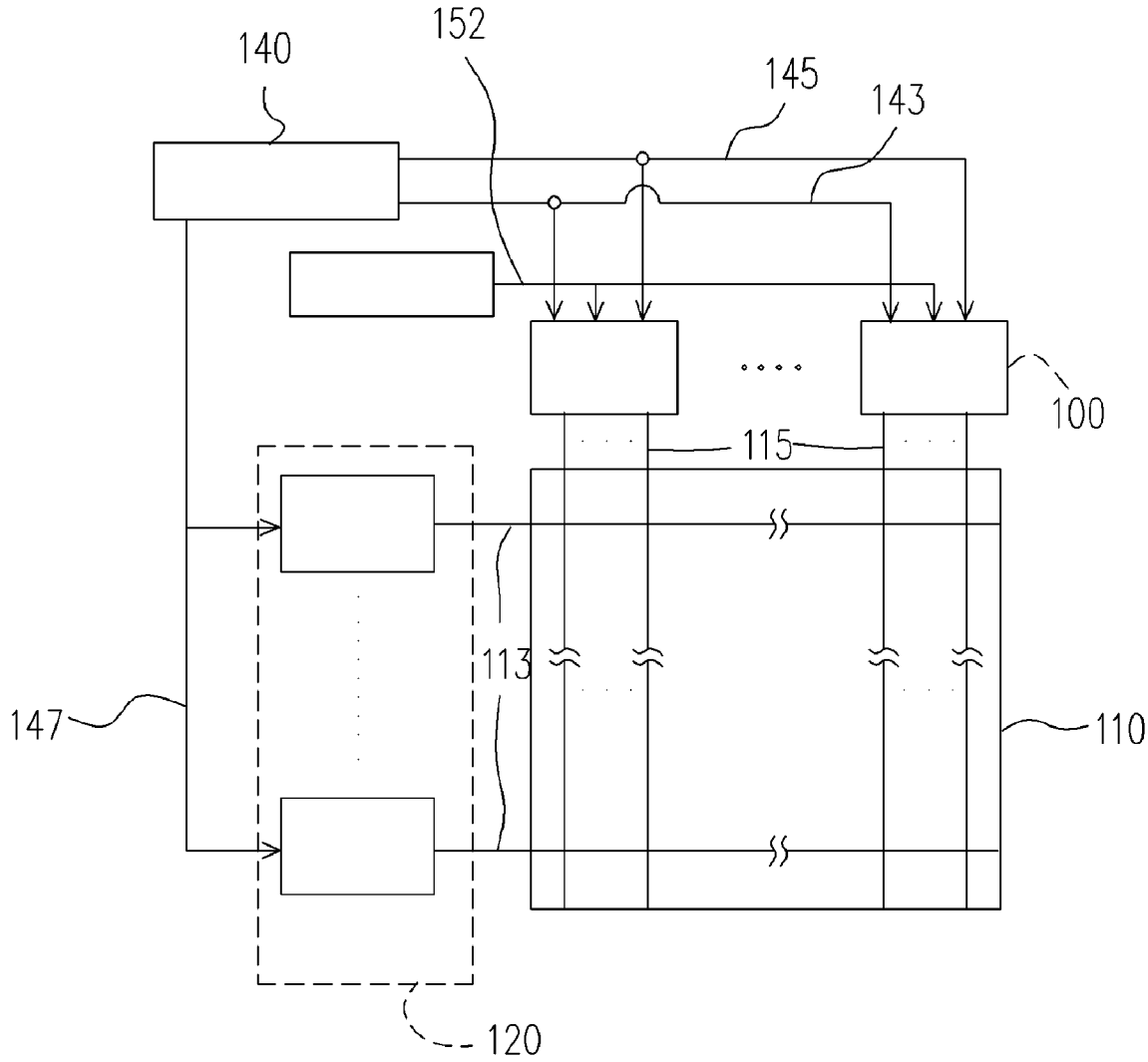
FIG. 1A(PRIOR ART)
FIG. 1A is a schematic circuit block diagram showing the driving circuit and source driving circuit of a conventional LCD.
Figure 1B:
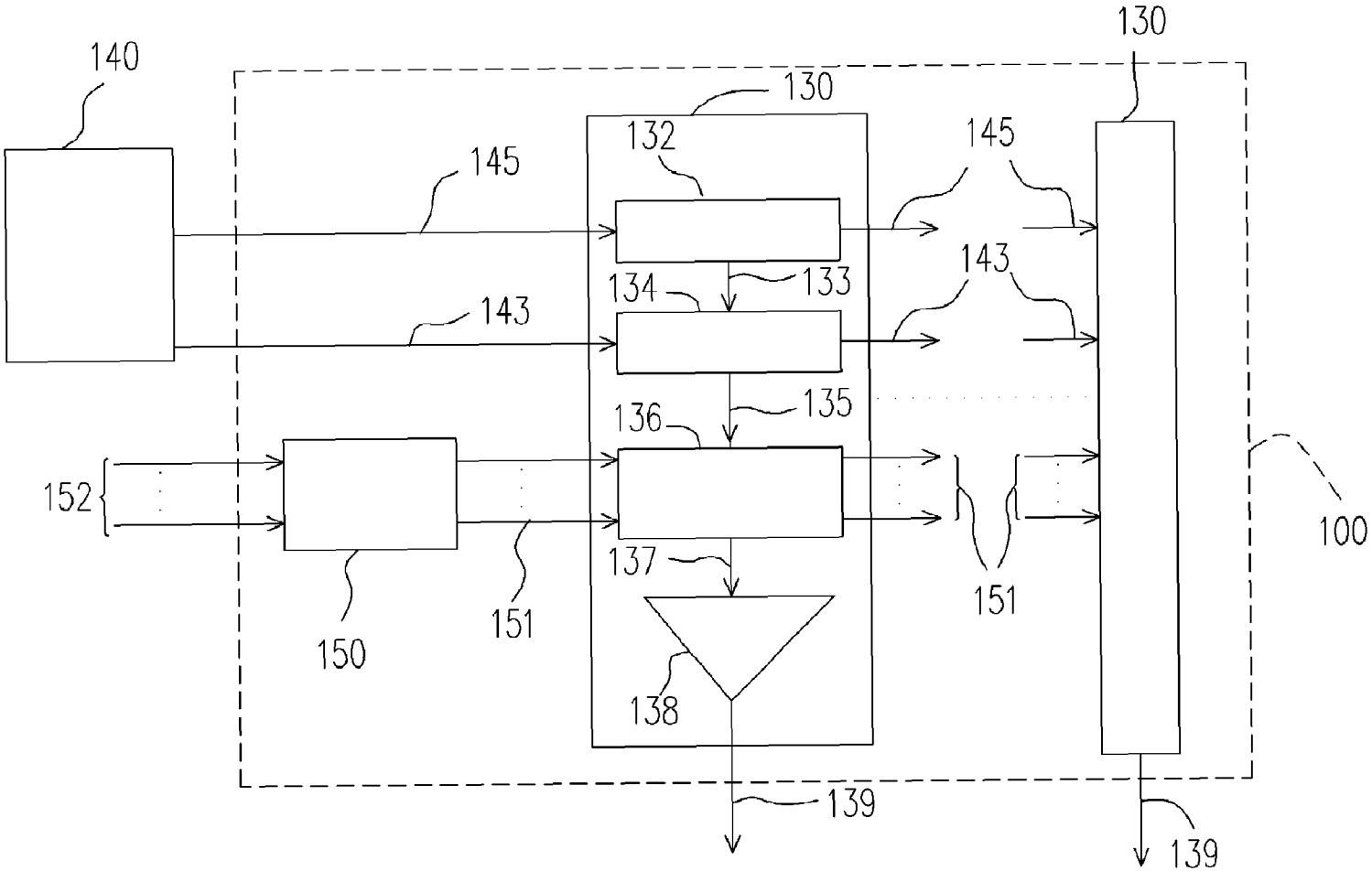
FIG. 1B(PRIOR ART)
FIG. 1B is a circuit block diagram of the source driver of FIG. 1A.

In another embodiment of the present invention, a flat panel display is disclosed. Referring to FIG. 1A, the source driver 100 in FIG. 1 can be, for example, replaced by the source driver 200 shown in FIG. 2. The flat panel display of the present invention includes a display panel, a timing controller, a set of gate driving circuits and a set of source driving circuits. The display panel has a plurality of pixels. The timing controller is provided for outputting a scanning signal, a first display data and a horizontal synchronous signal. The set of gate driving circuits has a plurality of gate drivers for receiving the scanning signal. The set of source driving circuits has a plurality of source drivers, wherein each of the source drivers transfers a first display data to an image driving signal according to the timing of the horizontal synchronous signal. The source driver includes, for example but not limited to, a gamma voltage generator, a plurality of first buffers and a converter. The gamma voltage generator is used for providing a plurality of first gamma voltages. Each of the first buffers is provided for receiving each first gamma voltages to generate a second gamma voltage. The converter is provided for receiving the second gamma voltages and the first display data to output the image driving signal according to the first display data to select one of the corresponding second gamma voltages. The driving circuit has a structure similar to that of the driving circuit described above and therefore detail description thereof is not repeated.

It is preferable that the flat panel display includes, for example but not limited to, a liquid crystal display (LCD), an amorphous silicon LCD, a low temperature poly-silicon LCD, an organic light emitting diode display, or a reflective LCD. More preferably, the reflective LCD includes, for example but not limited to, a liquid crystal on silicon (LCOS).

Accordingly, in the present invention since a buffer is disposed at each gamma voltage output terminal of the gamma voltage generator, and therefore buffers need not be disposed at the source terminals as required in the prior art liquid crystal display. Therefore, the present invention can reduce the power consumption and heat generation from the buffers. Moreover, the present invention also reduces the number of components in the driving circuit device allowing further shrinkage in size and area of the driving circuit and reduces the cost. Because the need of a buffer for each source terminal can be avoided, and therefore when the number of source terminals increase with the increase of in the number of pixels, buffers for the source terminals are not required. Accordingly, the number of the components in the driving device can be significantly reduced allowing shrinkage in size and area of the driving circuit and also the cost thereof can be significantly reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. A flat panel display, comprising:

a display panel, having a plurality of pixels;

a timing controller, for outputting a scanning signal, a first display data and a horizontal synchronous signal;

a set of gate driving circuits, having a plurality of gate drivers for receiving the scanning signal; and a set of source driving circuits having a plurality of source drivers, wherein each of the source drivers converts a first display data into an image driving signal according to a timing of the horizontal synchronous signal, wherein the source driver comprises:

a gamma voltage generator, for providing a plurality of first gamma voltages;

a plurality of first buffers, wherein each of the first buffers is provided for receiving each of the first gamma voltages to generate a second gamma voltage respectively; and a converter, for receiving the second gamma voltages and the first display data to output the image driving signal by selecting one of the second gamma voltages according to the first display data.

2. The flat panel display of claim 1, wherein the gamma voltage generator further receives a plurality of gamma adjusting voltages in order to generate the corresponding first gamma voltages.

3. The flat panel display of claim 1, wherein the first display data comprises a set of data in parallel.

4. The flat panel display of claim 1, wherein the converter comprises a D/A converter.

5. The flat panel display of claim 1, further comprising:

a second display data;

a horizontal synchronous signal;

a shift register, for receiving the second display data to generate a third display data; and a second buffer, for receiving the third display data and the horizontal synchronous signal to latch the third display data according to a timing of the horizontal synchronous signal and to generate the first display data.

6. The flat panel display of claim 5, wherein the second display data comprises a set of data in serial.

7. The flat panel display of claim 5, wherein the second buffer comprises a line buffer.

8. The flat panel display of claim 1, wherein the flat panel display comprises a liquid crystal display (LCD).

9. The flat panel display of claim 1, wherein the flat panel display comprises an amorphous silicon LCD.

10. The flat panel display of claim 1, wherein the flat panel display comprises a low temperature poly-silicon LCD.

11. The flat panel display of claim 1, wherein the flat panel display comprises an organic light emitting diode display.

12. The flat panel display of claim 1, wherein the flat panel display comprises a reflective LCD.

13. The flat panel display of claim 12, wherein the reflective LCD comprises a liquid crystal on silicon.

14. A driving circuit of a display, for converting a first display data into an image driving signal, comprising:

a first display data;

a gamma voltage generator, for providing a plurality of first gamma voltages;

a plurality of first buffers, wherein each of the first buffers is provided for receiving each of the first gamma voltages to generate a second gamma voltage respectively; and a converter, for receiving the second gamma voltages and the first display data to output an image driving signal by selecting one of the second gamma voltages according to the first display data.

15. The driving circuit of claim 14, wherein the gamma voltage generator further receives a plurality of gamma adjusting voltages in order to generate the first gamma voltages corresponding to the gamma adjusting voltages.

16. The driving circuit of claim 14, wherein the first display data comprises a set of data in parallel.

17. The driving circuit of claim 14, wherein the converter comprises a D/A converter.

18. The driving circuit of claim 14, further comprising:

a second display data;

a horizontal synchronous signal;

a shift register, for receiving the second display data to generate a third display data; and a second buffer, for receiving the third display data and the horizontal synchronous signal to latch the third display data according to a timing of the horizontal synchronous signal and to generate the first display data.

19. The driving circuit of claim 18, wherein the second display data comprises a set of data in serial.

20. The driving circuit of claim 18, wherein the second buffer comprises a line buffer.

* * * * *